United States Patent [19]

Stumpp

[11] 4,187,813

[45] Feb. 12, 1980

[54] FUEL SUPPLY DEVICE

[75] Inventor: Gerhard Stumpp, Stuttgart, Fed. Rep. of Germany

[73] Assignee: Robert Bosch GmbH, Stuttgart, Fed. Rep. of Germany

[21] Appl. No.: 894,210

[22] Filed: Apr. 6, 1978

[30] Foreign Application Priority Data

Apr. 7, 1977 [DE] Fed. Rep. of Germany ..... 2715587

[51] Int. Cl.[2] ..... F02B 77/00; F02M 31/00

[52] U.S. Cl. ..... 123/136; 123/122 D; 137/209

[58] Field of Search ..... 123/136, 122 D, 139 AF, 123/41.31; 137/209, 588; 220/44; 180/54 R

[56] References Cited

U.S. PATENT DOCUMENTS

| | | | |
|---|---|---|---|
| 3,090,421 | 5/1963 | Anders | 137/209 |
| 3,548,796 | 12/1970 | Gastinne | 123/136 |
| 3,789,812 | 2/1974 | Berry et al. | 123/136 |
| 3,973,536 | 8/1976 | Zelders | 123/136 |
| 4,126,110 | 11/1978 | Simmons | 123/122 D |

FOREIGN PATENT DOCUMENTS

| | | | |
|---|---|---|---|
| 703983 | 2/1941 | Fed. Rep. of Germany | 123/136 |
| 509278 | 7/1939 | United Kingdom | 123/136 |

*Primary Examiner*—Charles J. Myhre
*Assistant Examiner*—P. S. Lall
*Attorney, Agent, or Firm*—Edwin E. Greigg

[57] ABSTRACT

A fuel supply device for internal combustion engines wherein the temperature of the fuel fed to an injection pump can be regulated in order to avoid temperature influences on the fuel metering operation. For this purpose, fuel is withdrawn in a controlled quantity via a temperature-controlled valve from the intake chamber of the injection pump, where the fuel is under the feed pressure of a fuel feed pump and the withdrawn fuel is fed, either by way of a heat exhchanger or directly back to the intake side of the fuel feed pump. In this arrangement, the inherent fuel heating process taking place in the fuel injection pump is exploited to regulate the temperature of the fuel fed to the fuel feed pump.

6 Claims, 5 Drawing Figures

FUEL SUPPLY DEVICE

BACKGROUND OF THE INVENTION

The invention relates to a fuel supply system for an internal combustion engine having a fuel injection pump for conveying a controlled amount of fuel to be injected into the engine. These systems have a fuel feed pump for feeding fuel under pressure to the intake chamber of the fuel injection pump, and in such an arrangement, it is conventional to control the temperature of the fuel fed to this injection pump via the fuel feed pump disposed externally of the injection pump. For this purpose, the outside air temperature, or the exhaust air temperature of the heat exchanger for the cooling cycle of the internal combustion engine, is detected with the aid of a temperature sensor, and the distribution of the fuel fed to the injection pump, by way of a heater-type heat exchanger and a bypass conduit connected thereto, is controlled according to this temperature.

This arrangement solves the problem of increasing the fuel temperature with an increase in the outside temperature, thus reducing the amount of injected fuel effective for the combustion process, but entails the disadvantage, in that this control procedure is affected adversely if the amount of injected fuel is to be regulated accurately by volumetric metering in order to attain a maximum of efficiency without exceeding the limits of the maximally permissible content of deleterious substances in the exhaust gas. Even with this arrangement which, by the way, is very expensive, the effective amount of fuel fed in metered amounts varies greatly with fluctuating outside temperatures and an ensuing fluctuating density of the fuel which gradually adapts to this temperature. Consequently, large tolerances must be provided for the regulation of metered fuel fed to the system, or effective compensating units must be additionally included.

OBJECT AND SUMMARY OF THE INVENTION

The fuel supply device according to this invention comprises a fuel temperature responsive valve in a relief conduit downstream of an intake chamber of a fuel injection pump pressurized by a fuel feed pump for recirculating a controlled amount of fuel back to the intake of said fuel feed pump. Depending on the temperature of the fuel in the valve, the fuel is fed back directly to the intake of the fuel feed pump or to a heat exchanger, then to the intake of the fuel feed pump. The advantage of this invention, in contrast to the above, is that the fuel temperature can be regulated in a simple manner so to assume and maintain an essentially constant value. In this connection, heating the fuel in and by the injection pump is advantageously exploited for heating the fuel to a specific temperature which then is to be maintained at a constant value.

As is known, the fuel is heated up in the intake chamber of the injection pump due to frictional heat and due to the amount of fuel heated by compression during the injection stroke and flowing back into the intake chamber in case the working stroke is not fully utilized in the partial-load range of the internal combustion engine. Only if the fuel becomes too hot is it necessary to add a cooling unit to the cycle. The injection pump is heated also due to the internal combustion engine with which the pump is associated.

An especially advantageous feature of the invention resides in the fact that although a special heat exchanger may be provided, the fuel tank preferably serves as the cooling unit. Using the fuel tank as a cooling unit, desired fuel temperature control is thus attained with very little expenditure without requiring additional devices for warming or cooling the fuel. It is furthermore very advantageous that the valve, which can switch the flow of fuel in response to fuel temperature, comprises a bimetallic spring as the valve closing element and temperature control member, this spring being surrounded by the fuel flowing from the injection pump to the valve.

Also disclosed is a heating unit to be provided in the event such a unit is necessary which can be operated by a special heat source or by the heat generated by the internal combustion engine. In other applications simply covering the branch conduit returning the fuel to the fuel feed pump with an insulating material and locating a portion of the conduit near the engine is all that is necessary.

The invention will be better understood as well as further objects and advantages thereof become more apparent from the ensuing detailed description of four preferred embodiments taken in conjunction with the drawings.

DESCRIPTION OF THE EMBODIMENTS

Figure 1:
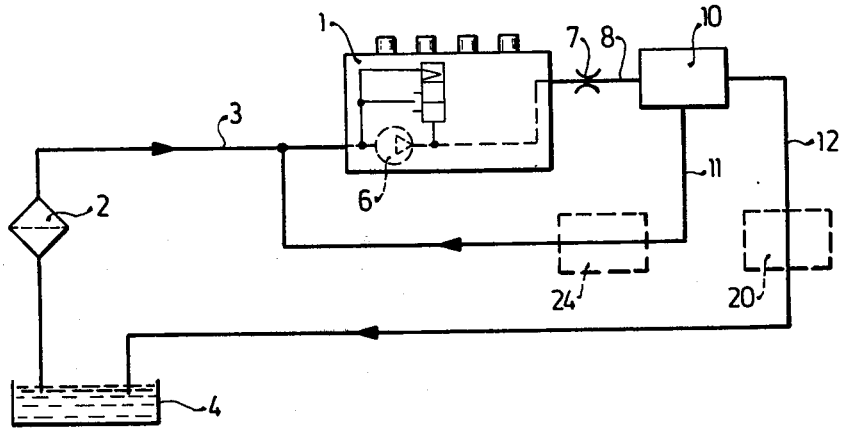
FIG. 1 shows a first embodiment of a fuel supply device.

The first embodiment is illustrated in FIG. 1 in a rather simple representation. Fuel is conducted via a suction line 3 equipped with a filter 2 from a fuel tank 4 to a fuel injection pump 1, serving for feeding fuel to an internal combustion engine, not illustrated in detail. A fuel feed pump 6 is normally provided for this purpose and as shown in this embodiment, the pump can be integral with the fuel injection pump or, in another version, the pump can also be connected upstream of this injection pump. This fuel feed pump 6 conveys the fuel into the intake chamber of the injection pump 1. The intake chamber is conventionally maintained under a specific pressure and if this pressure is exploited for control purposes, it is additionally regulated. The fuel to be fed to the internal combustion engine is withdrawn from the intake chamber in a conventional manner during the intake stroke of the injection pump pistons. The amount of fuel not required during the injection stroke of the pump pistons, for example in the partial load range, is recycled into the intake chamber and due to this process, in particular, the fuel is heated up in the intake chamber. Furthermore, a portion of the fuel conveyed by the fuel feed pump 6 is also discharged from the intake chamber by way of a throttle 7 which, depending on the design of the injection pump, can be a fixed throttle or a variable throttle. In case of series-type injection pumps wherein no control functions are carried out with the aid of the pressure in the intake chamber, the throttle can also be replaced by a check valve. This recirculation of a quantity of fuel serves, in conventional arrangements, for relieving the temperature load on the injection pump and for removing proportions of air in the fuel from the intake chamber and is generally called flushing of the pump.

In the illustrated embodiment, a relief conduit 8 leads from the throttle 7 to a temperature responsive switch valve 10. From this valve extend a first branch conduit 11 and a second branch conduit 12 of the relief conduit 8. The first branch conduit 11 leads directly back to the suction line 3 and/or to the intake side of the fuel feed pump 6 of the injection pump 1. In contrast thereto, the second branch conduit 12 extends into the fuel tank 4.

Figure 2:
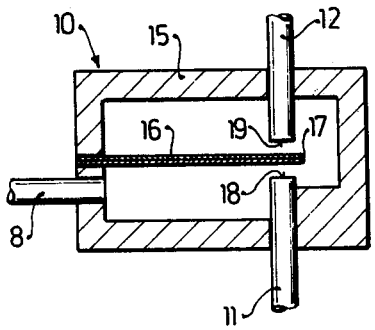
FIG. 2 shows a detailed view of the structure of the valve switchable in response to temperature in accordance with the embodiment of FIG. 1.

FIG. 2 shows a more detailed illustration of the structure of the valve 10, operated in response to fuel temperature. Thus, the valve 10 consists of a closed housing 15 in which is fixedly inserted a bimetal spring 16 on one side; the free end 17 of this spring is arranged between the first branch conduit 11 and the second branch conduit 12, which extend out of the housing coaxially to each other and at right angles to the central position of the bimetal spring 16. The opening 18 of the first branch conduit 11 and the opening 19 of the second branch conduit 12 constitute in each case a valve seat; the free end 17 of the bimetal spring 16 cooperating therewith as the valve closing element. The relief conduit 8 terminates in the housing 15 in parallel to the bimetal spring 16, so that the entering fuel can flow along the bimetal spring either to the opening 18 or 19 of the branch conduits and can be discharged at those points. This entails the advantage that the bimetal spring detects very quickly the instantaneous fuel temperature exhibited by the fuel entering via the relief conduit 8.

The aforedescribed device operates as follows: When the injection pump 1 commences operation, the initially cool fuel from the fuel tank 4 is conveyed via the suction line 3 through the fuel feed pump 6 to the injection pump 1. Since the injection pump is likewise still cold in this condition, the fuel flows via the throttle 7 at about the same temperature to the valve 10, operable to switch the fuel flow between branch 11 or 12 dependent on the temperature of the fuel. In accordance with this cool fuel temperature, the bimetal spring 16 is deflected so that the second branch conduit 12 to the fuel tank is blocked, and the fuel is recycled via the first branch conduit 11 directly to the intake side of the fuel feed pump 6. During the further operation, the fuel injection pump is conventionally heated up so that likewise warmed fuel leaves the fuel pump via the relief conduit 8. However, as long as the fuel is still colder than a predeterminable value of, for example, 40° C., the step of feeding the amount of fuel for flushing purposes back to the intake side of the fuel feed pump 6 is continued, so that the fuel injection pump and the fuel in the intake chamber thereof are rapidly heated to the desired value.

As soon as the temperature of the fuel leaving the injection pump via the relief conduit 8 has risen beyond the desired value, the bimetal spring 16 opens the second branch conduit 12 to the fuel tank 4 so that, in correspondence with the degree to which the branch conduit 12 is opened, a portion of the amount of flushing fuel is returned to the fuel tank 4 and the fuel feed pump 6 must supply a greater amount of cold fuel, in correspondence with this partial quantity, from the tank to the injection pump 1. In this way, the fuel temperature in the intake chamber of the fuel injection pump 1 is regulated so as to maintain a constant temperature value.

This arrangement has the advantage that the fuel tank 4 is utilized as the cooling unit. These fuel tanks are normally located in automobiles at a very exposed point and are cooled, in part, by the air stream when the vehicle is moving. Furthermore the fuel tank can be fashioned so that an improved cooling of the fuel present therein is made possible. In this way, a separate cooling unit in the second branch conduit 12 is unnecessary. Of course, as indicated in dashed lines in the drawing, such a cooling device 20 can be provided.

Advantageously, the device of this invention exploits the inherent heating process taking place in the fuel injection pump for warming the fuel fed from the fuel tank 4 to the injection pump, and if the fuel is regulated so as to maintain a certain temperature value with the aid of the fuel temperature responsive valve which switches the flow of fuel in response to the temperature. This control of the fuel temperature has the advantage of accurately controlling the amount of fuel injected so as not to be affected by fluctuating fuel temperatures. In case of diesel injection pumps, a rise in temperature of 10° C. can lead to a falsification of the amount of fuel injected by a 1 $mm^3$/stroke. This leads, depending on whether the value is above or below a specific, medium temperature, to a loss in efficiency or to an excessive amount of deleterious substances in the exhaust gases of the internal combustion engine.

Figure 3:
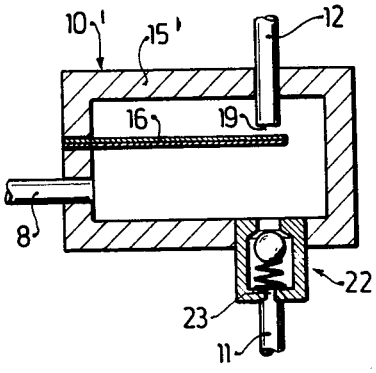
FIG. 3 shows a second embodiment of the valve switchable in response to temperature, which can be utilized in the embodiment of FIG. 1.

While the temperature switch valve is fashioned, in the embodiment of FIG. 2, so that, if the temperature of the entering fuel is too high, the opening 18 of the first branch conduit 11 can be completely closed, and, if the temperature of the fuel is too low, the opening 19 of the second branch conduit 12 can be completely closed, the valve 10' and its housing 15' according to the second embodiment in FIG. 3 is constructed so that only the opening 19 of the second branch conduit 12 can be blocked off by the bimetal spring 16. A spring actuated ball valve 22 which opens in the discharge direction, is provided at the branching point of the first branch conduit 11 so that when the branch conduit 12 is closed, the fuel fed to the valve 10' can be discharged by way of this valve 22. In a simplified arrangement, the valve illustrated therein can be replaced by a fixed throttle 23 in the first branch conduit 11. This arrangement results in a greatly simplified device for controlling the fuel temperature.

Figure 4:
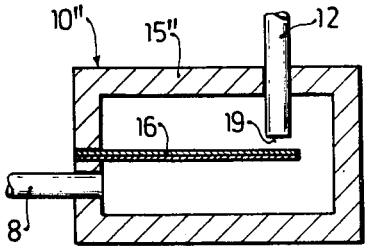
FIG. 4 shows a third embodiment of the valve switchable in response to temperature.

In a third embodiment (FIG. 4), a temperature controlled switch valve 10'', is provided which is of essentially identical construction to the valve 10, as shown in the first embodiment of FIG. 2. However, the embodiment of FIG. 4 includes only a second branch conduit 12. The mouth 19 of this branch conduit 12, extending into housing 15'', is controlled by the end of the fixedly clamped bimetal spring 16. The bimetal spring disconnects the communication between the relief conduit 8 and the fuel tank 4 so that if the temperature of the fuel is too low, no fuel can be discharged from the injection pump 1. This device can be utilized particularly in connection with series-type injection pumps operated by means of a separate initial conveying pump. Thus, in this arrangement, the flushing of the injection pump is prevented as long as a desired operating temperature of the injection pump, controllable by the bimetal spring 16, has not been reached. The fuel in the injection pump is heated up, as is known, while the injection pump is operating and is fed back in partial amounts to the fuel tank when the set fuel temperature is exceeded. In correspondence with this partial amount of fuel fed back, an increased quantity of cold fuel must be fed to the fuel injection pump.

For extreme situations, it is possible in the embodiments of FIGS. 1–3 to provide, in the first branch conduit 11 an additional heating unit controlled by the fuel temperature, in order to effect a more rapid heating up operation or to sufficiently maintain the temperature level. This can be accomplished by way of a heat exchanger 24 which is either heated electrically or utilizes the inherent heat generated in the internal combustion engine for heating the fuel. In other instances, it is advantageous to protect the first branch conduit 11 from cooling off by means of an insulation and to install this branch conduit in a protected location or along zones exposed to the heat of the internal combustion engine.

Figure 5:
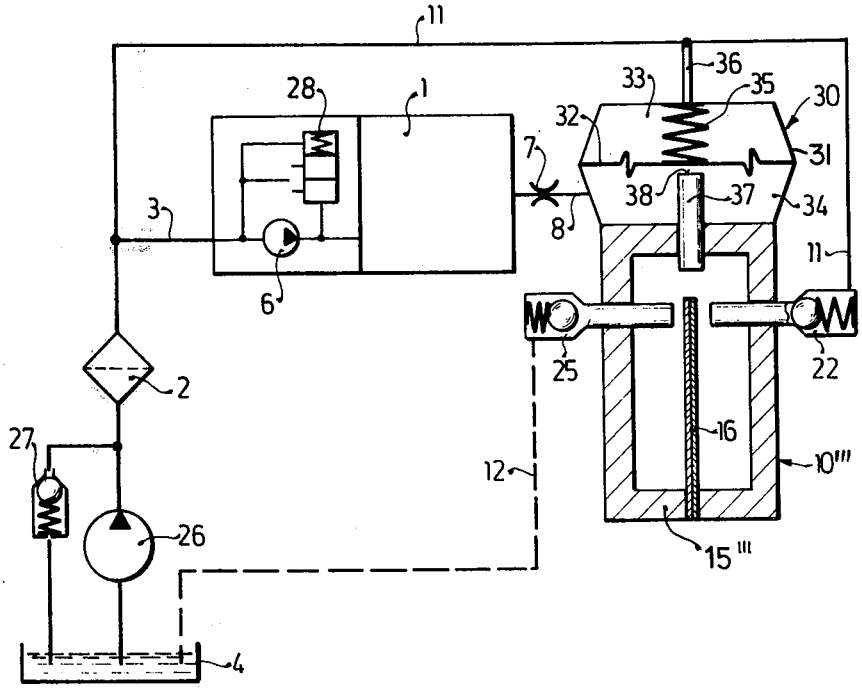
FIG. 5 shows a fourth embodiment.

The fourth embodiment (FIG. 5) comprises an injection pump 1 with a fuel feed pump 6 integral therewith and an initial feed pump 26 with a fuel filter 2 connected downstream thereof in the intake conduit 3 of the fuel feed pump. Pressure control valves 27 and 28 are conventionally inserted in backflow conduits in parallel to both pumps; one for each pump respectively. The relief conduit 8 extends from the injection pump 1 via the throttle 7 to a valve 10''', which can switch the fuel flow in response to temperature as in the embodiment of FIG. 2. The valve 10''' comprises the bimetal spring 16 clamped within the housing 15''' with the end of this spring controlling the orifices 18 and 19 of the first branch conduit 11 and the second branch conduit 12 extending into the housing. In a deviation from the arrangement of FIG. 2, check valves 22 and 25, are disposed one in each of the branch conduits with each of these check valves opening in the discharge direction. The valve 22 in the branch conduit 11 prevents fuel from being conveyed directly into the valve 10''', circumventing the injection pump, and the valve 25 prevents the feed pump 6 from taking in unfiltered fuel from the tank when the branch conduit 12 is open. The relief conduit 8 is controlled at its inlet point into the housing 15''' by means of a differential pressure valve 30 so that a constant pressure is obtained due to its regulation function downstream of the throttle 7, and the control pressure in the intake chamber of the injection pump is not affected by the temperature controlled switch valve 10'''.

The differential pressure valve 30 consists of a housing 31 with a diaphram 32 clamped in this housing, dividing the latter into a control pressure chamber 33 and a controlled pressure chamber 34. A compression spring 35 is clamped between the diaphragm 32 and the housing 31. Furthermore, from the control pressure chamber 33, the diaphragm is exposed to the pressure in the suction line between the filter 2 and the feed pump 6, since the control pressure chamber 33 is in communication with the first branch conduit 11 via the connecting line 36. The relief conduit 8 terminates in the controlled pressure chamber 34 and extends via a connecting nipple 37, the orifice 38 of which is controlled by the diaphragm 32, into the housing 15 of the valve 10''' switchable in response to temperature.

Thus the valve 10''' with differential pressure valve 30 in addition to controlling fuel flow to the intake of the fuel feed pump also controls fuel pressure downstream of the throttle 7 at a predetermined constant pressure.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. In combination with a fuel injected internal combustion engine having a fuel injection pump, a fuel feed pump and a fuel tank, a fuel temperature control system comprising:

means connecting said fuel feed pump to supply fuel from said tank to the inlet of said fuel injection pump;

fuel relief conduit means including throttle means connected to said fuel injection pump; and temperature controlled valve means operable in response to fuel temperature connected between the outlet of said throttle means and at least said tank and operable to conduct fuel from said throttle means to said fuel tank if the fuel temperature is above a predetermined value and to block flow to said tank if the fuel temperature is below said predetermined value.

2. The combination defined by claim 1, wherein said temperature controlled valve means comprises:

a housing;

means for admitting fuel to the interior of said housing;

a bimetal spring within said housing having one end secured thereto; and a least one conduit extending through said housing and positioned to be closed by the free end of said spring depending upon the fuel temperature.

3. The combination defined by claim 2, including a pair of conduits extending through said housing on opposite sides of said bimetal spring and positioned to be selectively closed by said bimetal depending upon fuel temperature, one of said conduits connecting said housing to said tank and the other connecting said housing to the inlet of said feed pump.

4. The combination defined by claim 2 including a pair of conduits extending through said housing, one positioned to be closed by said bimetal at a predetermined temperature and connected to said fuel tank and the other including a check valve opening outwardly of said housing and connected to the inlet of said fuel feed pump.

5. The combination defined by claim 3, including a heat exchanger for heating the fuel included in the connection between said temperature controlled valve means and the inlet of said feed pump.

6. The combination defined by claim 3, including a differential pressure valve connected between said throttle means and said temperature controlled valve means for maintaining the fuel pressure downstream of said throttle means at a constant value.

* * * * *